United States Patent [19]

Ahroni

[11] 4,385,282

[45] May 24, 1983

[54] FUSED PLUG CONTAINING SPARE FUSES HAVING SPARE FUSE ELEMENTS

[76] Inventor: Joseph M. Ahroni, 1631 16th Ave., #413, Seattle, Wash. 98119

[21] Appl. No.: 177,981

[22] Filed: Aug. 14, 1980

[51] Int. Cl.[3] ..... H01H 85/02

[52] U.S. Cl. ..... 337/198; 337/230; 337/257; 337/293

[58] Field of Search ..... 337/197, 198, 230, 257, 337/258, 259, 290, 293, 295

[56] References Cited

U.S. PATENT DOCUMENTS 1,281,553 10/1918 Gagnon ..... 337/230

1,462,195 7/1923 Doyle ..... 337/230

4,178,061 12/1979 Ahroni ..... 337/198 X 4,196,409 4/1980 Juba ..... 337/259

*Primary Examiner*—George Harris

*Attorney, Agent, or Firm*—Seed, Berry, Vernon & Baynham

[57] ABSTRACT

A fused plug has a fuse cavity containing active and spare fuses which can be alternated between active and inactive positions. The fuses in turn preferably each have multiple fuse elements which can be alternatively placed in active position by changing the position of the fuse in the fuse cavity.

27 Claims, 22 Drawing Figures

FIG. 19
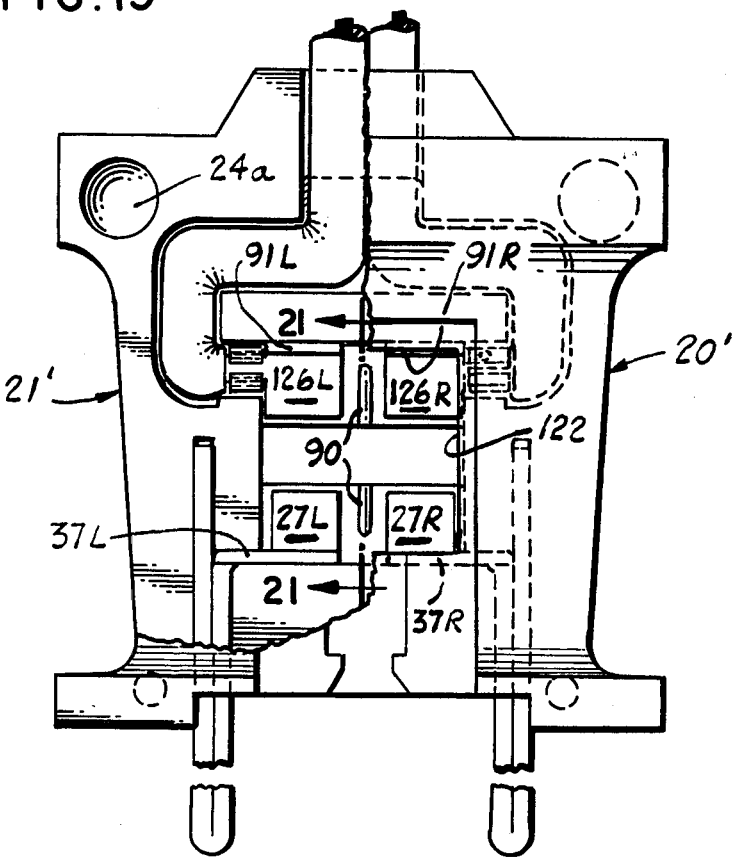
FIG. 20
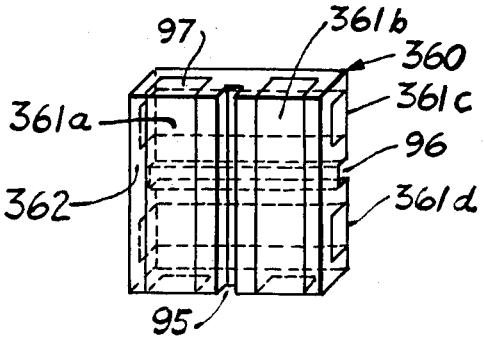
FIG. 21
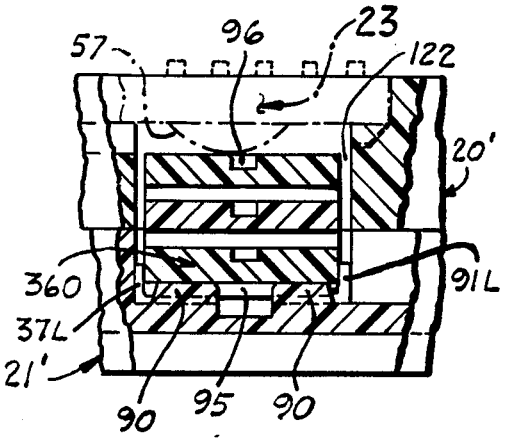
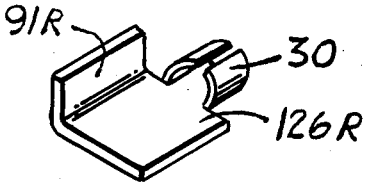
FIG. 22

FUSED PLUG CONTAINING SPARE FUSES HAVING SPARE FUSE ELEMENTS

BACKGROUND OF THE INVENTION

1. Field of the Invention

The present invention relates to fused electrical plugs, such as used, for example, on extension cords, and to the providing of spare fuses.

2. Description of the Prior Art and Needs

Electrical plugs having replaceable internal fuses for opening an electrical circuit responsive to excess current flow are known for use as add-on plugs in decorative light sets, as add-ons to extension cord plugs, and for direct use as extension cord plugs. Typical designs are shown in U.S. Pat. Nos. 1,904,691; 2,462,934; 3,833,875; 3,976,967; 4,080,039 and 4,178,061. If a fuse in one of these plugs is blown, there is, of course, need for a replacement fuse, but this may not be on hand and may be difficult to obtain if it is not a standard size or style. Accordingly, there is a need for a fuse plug providing its own spare fuses and for improved fuses to better meet the spare fuse requirement.

For safety reasons, the wire leads to an electrical plug should be firmly fixed in position in the plug body; but for economy of assembly, it is preferred that screw, rivet or solder connections not be required for holding the wire leads and their terminal contacts in position. It is also preferred for economy that the plug body be injection molded and that the wire leads, contacts and prongs of the plug unit be capable of being quickly placed in position after the body has been molded, and that this be done without sacrificing safe and reliable operation of the plug.

SUMMARY OF THE INVENTION

The present invention aims to meet the foregoing needs and requirements and to provide safe, reliable and economical fused plugs containing spare fuses which can be easily changed from a spare to an active position. In carrying out this objective, the invention also has as an important object the providing of an improved fuse having spare fuse elements.

In the preferred embodiment, the plug has a fuse cavity closed by a slide door unit which not only confines the fuses but keeps the active fuses in proper position. Spare fuses are provided in the fuse cavity which are either separated by a removable spacer engaged by the door unit to in turn press against the active fuses, or are engaged by the door and press directly against the active fuses to hold them in proper position. Standard cylindrical fuses can be used, but it is preferred to use an improved fuse having a fuse body on which multiple fuse element strips are secured in such a manner that they can each be alternatively brought into an active position by changing the position of the fuse body in the fuse cavity.

BRIEF DESCRIPTION OF THE FIGURES OF THE DRAWING

FIG. 19 is a view of a modified plug assembly taken like FIG. 4;

FIG. 20 is a perspective view of a modified fuse used in the FIG. 18 embodiment;

FIG. 21 is a detail sectional view taken as indicated by line 20—20 in FIG. 18; and FIG. 22 is a perspective view of a modified wire contact member used in the FIG. 18 embodiment.

DETAILED DESCRIPTION OF THE PREFERRED EMBODIMENTS

Figure 1:
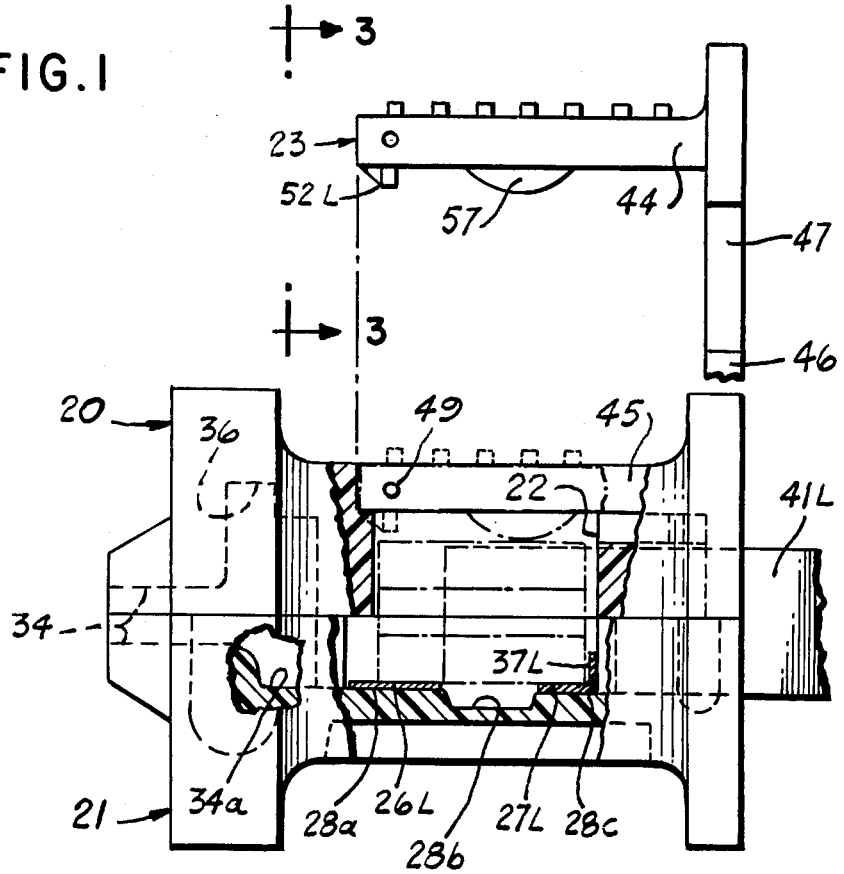
FIG. 1 is an exploded view in side elevation, with parts broken away, showing a plug assembly embodying the present invention and with the replaceable fuses being shown in phantom.
Figure 2:
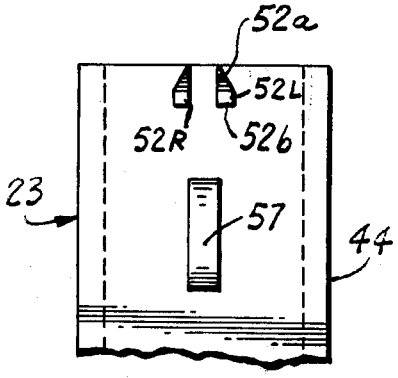
FIG. 2 is a fragmentary underside view of the plug cover.
Figure 3:
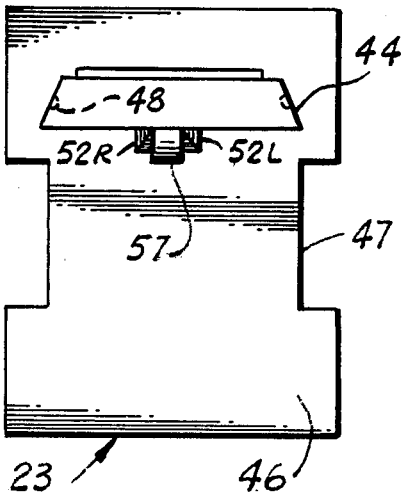
FIG. 3 is an end view of the cover as seen from the prong end of the plug.

Referring first to FIG. 1, it is seen that the body of the plug comprises front and back interfitting shells 20,21 collectively providing a central, generally rectangular cavity 22 for fuses which is exposed at the front and is closed by a slide door 23. Preferably, the body shells interfit by way of upper and lower pairs of dowels 24—24 and 25—25 projecting downwardly from the front shell 20 into pairs of mating openings **24*a*—24*a* and 25*a*—25*a* exposed to the top face of the lower shell 21. The shells 20,21** are permanently held together by a suitable adhesive or by ultrasonic sealing.

Figure 8:
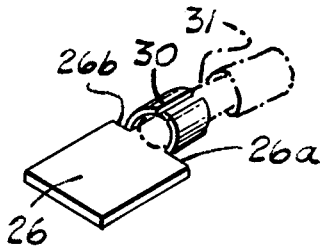
FIG. 8 is a perspective view of one of the wire control members.

Resting on the floor of the cavity 22 are upper and lower pairs of spaced contacts 26L–26R and 27L–27R, respectively, which may be separated by a transverse recess **28*b* formed in the cavity floor between upper and lower floor portions 28*a*,28*c* on which the contacts rest. The upper faces of the four contacts are made coplanar by appropriately varying the height of the faces 28*a* and 28*c* above the base of the recess 28*b* to compensate for differences in thickness of the metal of the upper and lower contacts. The upper contacts 26L–26R, best seen in FIG. 8, are electrically connected by integral extensions 30 to stripped terminal end portions 31 of insulated wire leads 32L–32R entering the plug through a top passage 34 provided collectively by the shells 20,21. At the lower end of the passage 34, the back shell 21 is formed with left and right wireway grooves 35L–35R of general U-shape shape which bend left and right, and then double back and intersect the central cavity 22 near the upper end thereof. The lower end portion 34***a* of the entry passage 34 in the lower shell and the grooves 35L–35R are deep enough to accommodate the full diameter of the wires 32L–32R. For weight reduction, the upper shell 20 may be formed with a stepped transverse recess 36 intersecting the lower end portion of the entry passage 34. However, the portion of the bottom face of the upper shell 20 opposite the central bend in the grooves 35L–35R is not recessed so that it will confine the wires 32L–32R therein.

Figure 4:
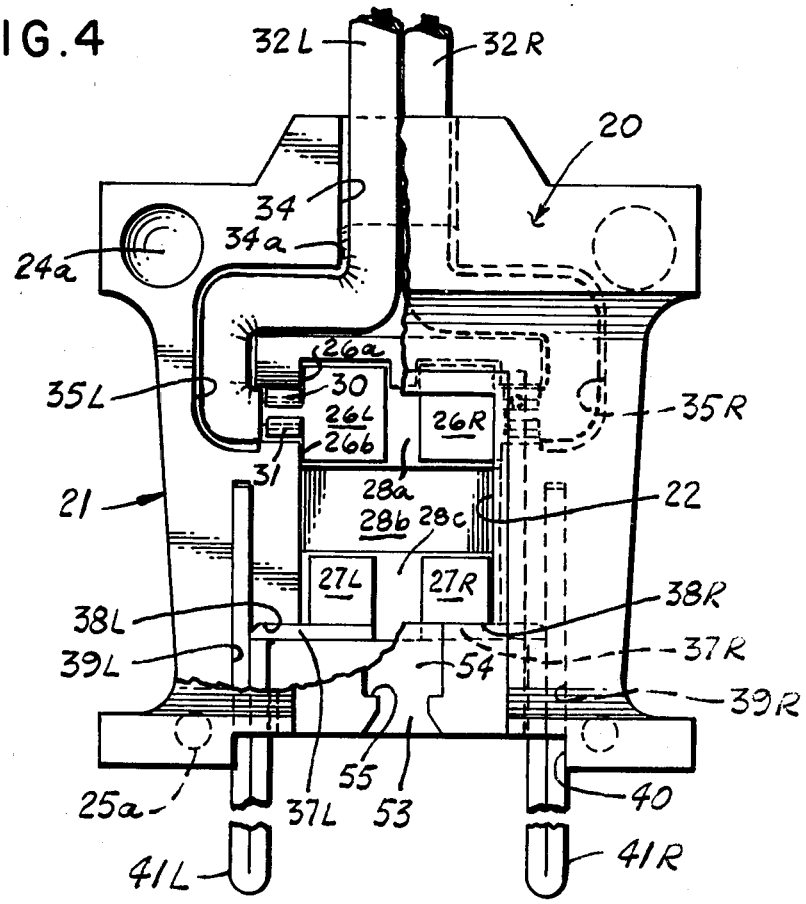
FIG. 4 is a front plan view of the plug assembly with part of the front body shell broken away.
Figure 6:
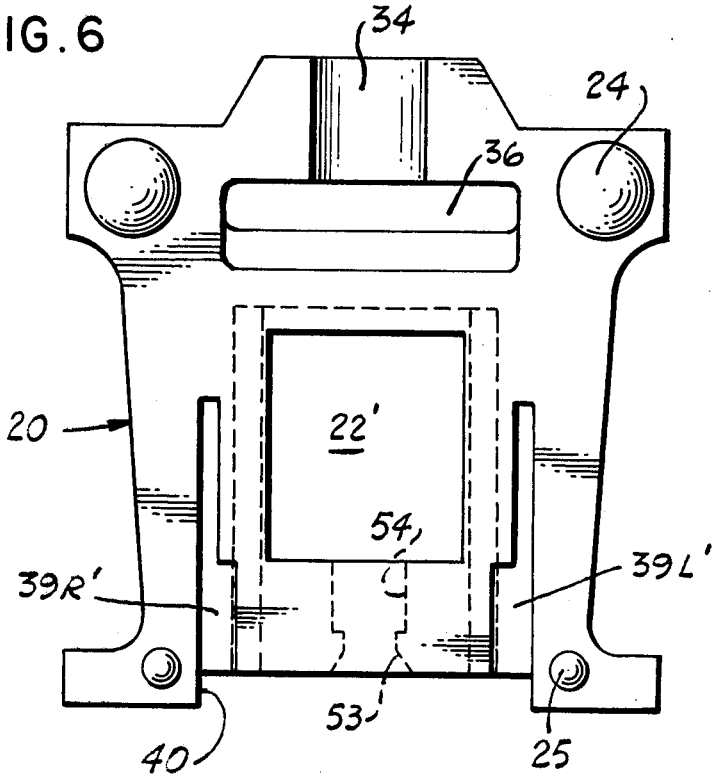
FIG. 6 is a rear plan view of the front body shell.
Figure 7:
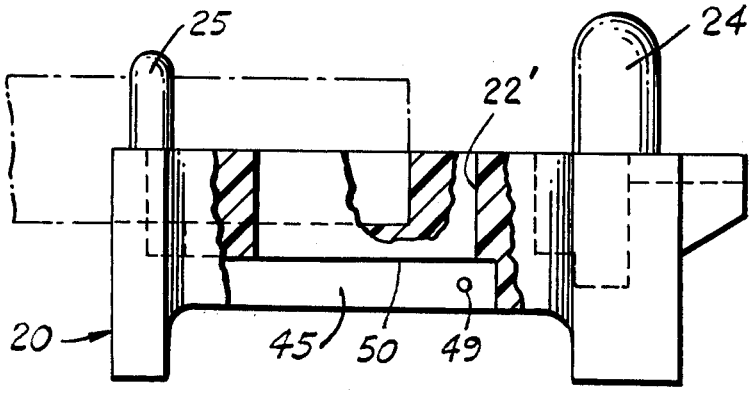
FIG. 7 is a side elevational view, partly broken away, of the front body shell.
Figure 9:
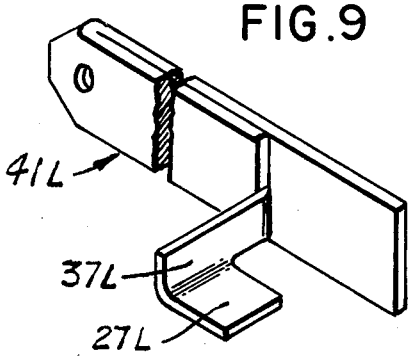
FIG. 9 is a perspective view of one of the prong members.

Directing attention to FIGS. 4 and 9, the lower contacts 27L–27R extend from opposed contact arms 37L–37R in turn projecting from the sides into the lower end of the central cavity 22 through forwardly facing grooves 38L–38R in the back shell 21. These grooves intersect longitudinally stepped grooves 39L–39R in the bottom shell 21 which are opposed by mating grooves 39L'–39R' in the front shell 20 (see FIG. 6). The mating grooves 39L–39R and 39L'–39R' connect at their lower ends with a rectangular recess 40 in the lower end of the plug body provided collectively by the body shells 20–21 and receiving prongs 41L–41R. As best seen in FIG. 9, each of these prongs is doubled back on itself at its projecting lower end and provides a respective one of the arms 37L–37R within the plug, these arms being half the width of the prongs.

It will be noted from FIGS. 4 and 8 that the crimped contact extensions 30 are narrower, after being crimped, than the upper contacts 26L,26R and that the resulting shoulder portions 26*a*–26*b*, by bearing against the respective sidewall of the lower portion of the central cavity within the bottom shell 21, help to prevent the wires 32L, 32R from being pulled out of the plug. However, the principal factor keeping the wires in position is the configuration of the wireway, and particularly the U-portions 35L–35R thereof.

Figure 5:
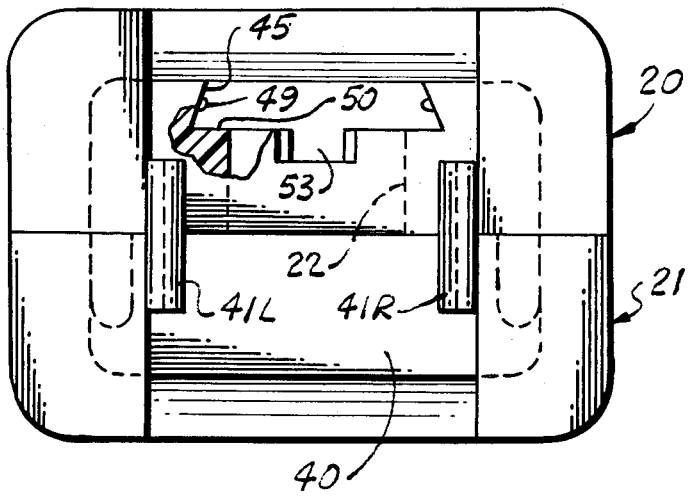
FIG. 5 is an end view of the plug assembly with the cover removed and as viewed from the prong end.

Continuing to the slide door 23, such has sloped side edges 44 to mate with beveled retaining walls 45 (FIG. 5) in the front body shell 21 which extend along the outer edges of a pair of tracks 50. These tracks extend along opposite sides of the rim of the mouth of a rectangular cutout 22' (FIG. 6) in the front shell 21 which defines the entry portion of the cavity 22. The door has a lower flange 46 forming handle with the cover proper, and the side edges of this handle are recessed at 47 to slide along the prongs 41L–41R. It will be noted that the door 23 is held in closed position by dimples 48 in the sides 44 thereof near the upper end which are arranged to mate with nibs 49 projecting inwardly from the beveled sides 45 of the slide tracks 50. When the plug is in use, the door 23 is also held in closed position by way of engagement of the handle 46 with the receptacle into which the plug is fitted.

The door 23 may also be formed with a keeper to prevent it from separating from the plug body when the door is opened to change fuses. This keeper may take the form of a pair of laterally spaced keeper lugs 52L–52R located between the dimples 48 and having their lead ends beveled at 52*a* so that the lugs will be bent toward one another when they are introduced through the flared mouth 53 of a bottom entry groove 54 (FIG. 4). When the lugs 52L–52R spring back to a relaxed position after entry, their trailing ends 52*b* spring outwardly to be opposed by locking shoulders 55 at the neck of the flared mouth 53, thereby preventing removal of the door.

Figure 10:
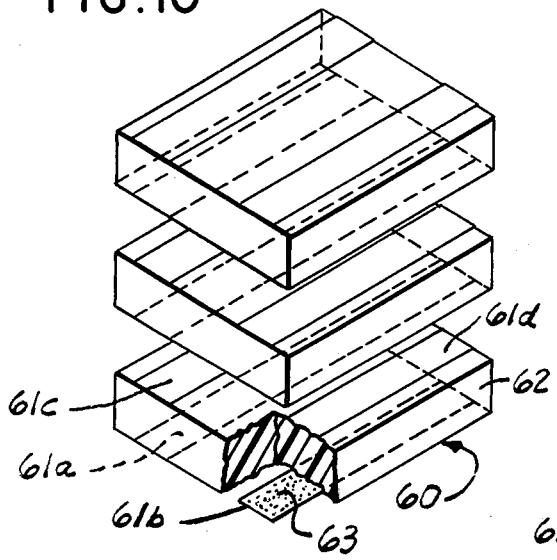
FIG. 10 is an exploded perspective view of a preferred embodiment of fuses.

It will be noted that the bottom entry groove 54 also permits entry of a central hold-down lug 57 in the underside of the door. This hold-down lug is preferably rounded and is provided to press against the upper of a set of fuses to keep proper fuse engagement with the contacts 26L–26R and 27L–27R. Referring to FIG. 10, there is shown a set of three suitable fuses 60, each having a pair of parallel bottom fuse elements 61*a*–61*b*, and a like pair of top fuse elements 61*c*–61*d*, to serve as spares. These fuse elements may be formed of uniform strips of zinc foil bonded by a suitable adhesive 63 to the fuse body, which is preferably formed of polyvinylchloride or another suitable plastic. The purpose of providing multiple fuses 60 is to give handy spares. In the example shown, since each of the three fuses 60 has two pairs of fuse elements 61*a*–61*b* and 61*c*–61*d*, the spare of which can be activated merely by turning over the fuse body 62, there are provided five extra pairs of fuse elements by the three fuses.

The rectangular cutout 22' in the top shell 20 defining the mouth of the cavity 22, is purposely not square and is matched by the shape of the fuse body 62 so that the fuses 60 will always be properly positioned in the cavity relative to the contacts 26L–26R and 27L–27R to be engaged by the fuse elements 61*a*–61*b* or 61*c*–61*d*. It will be noted that the hold-down lug 57 presses against the uppermost of the set of three fuses 60, but, because centrally located, never engages any of the fuse elements. Thus the door 23 is prevented from damaging the fuse elements while sliding open or closed.

Figure 11:
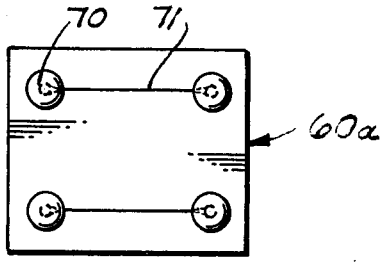
FIG. 11 is a plan view of a modified fuse.
Figure 12:
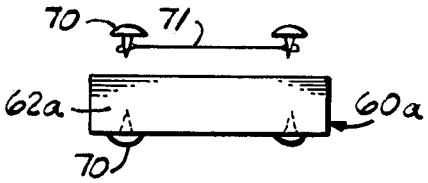
FIG. 12 is an exploded side view of the modified fuse of FIG. 11.

As an alternative to fuses 60, in FIGS. 11 and 12, I have illustrated fuses 60*a* in which each of the fuse elements comprises a pair of tacks 70 and a filament wire 71 which is wound at both ends around the shank of the tacks 70. The fuse body 62*a* is preferably formed with undersized holes into which the tacks 70 may be pressed for a snug fit. With this arrangement, the heads of the tacks 70 serve as fuse contacts to engage the wire contacts 26L–26R and prong contacts 27L–27R.

Figure 13:
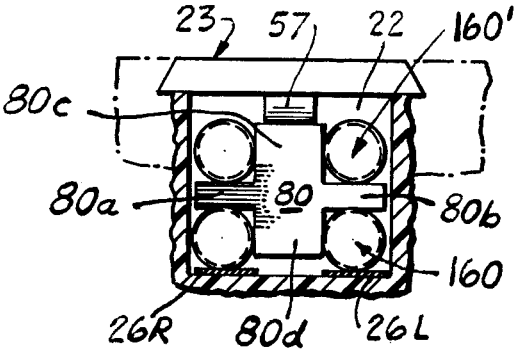
FIG. 13 is an end view of another spare fuse arrangement.
Figure 14:
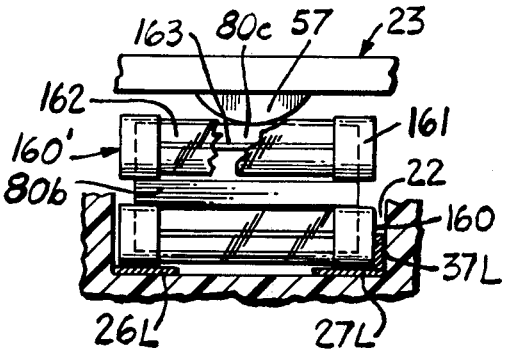
FIG. 14 is a side elevational view of the fuse arrangement of FIG. 13.

Referring to FIGS. 13–14, there is illustrated a modified fuse arrangement in which standard tubular fuses 160 are used of the type having conductive metal caps 161 fitting over the ends of a glass tube 162 in which a wire fuse element 163 is housed and connects to the end caps 161. In the illustrated embodiment, two juxtapositioned pairs of the fuses 160 are used, the bottom pair being active and the upper pair 160' being spares. The active and spare pairs 160–160' are separated by the arms 80*a*–80*b* of a cross-shaped spacer 80 having legs 80*c*–80*d*. Legs 80*d* separate the active fuses 160 while the leg 80*c* separates the spare fuses 160'. Important is the fact that the hold-down lug 57 on the door 23 presses on the top of the leg 80*c* and thereby causes the arms 80*a*–80*b* to press down on the caps 161 of the active fuses 160 and hold them in engagement with the contacts 26L–26R and 27L–27R.

Figure 15:
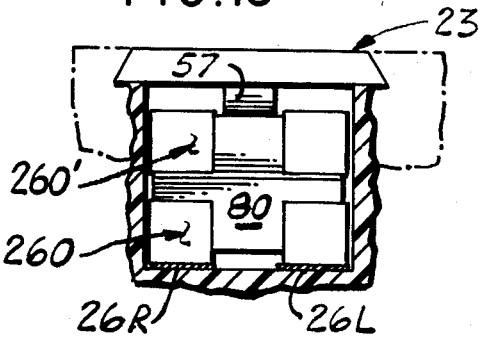
FIG. 15 is an end view of still another fuse arrangement, the related portion of the plug body being shown in section.
Figure 16:
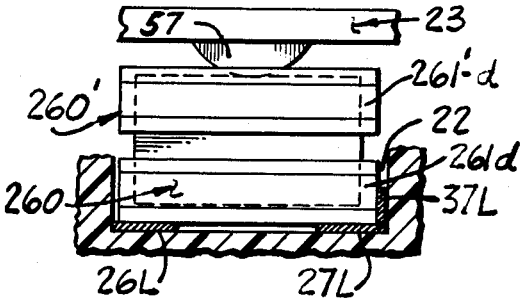
FIG. 16 is a side elevational view of the fuse arrangement of FIG. 15, with the related portions of the plug body and door being shown in section and fragmentarily, respectively.
Figure 17:
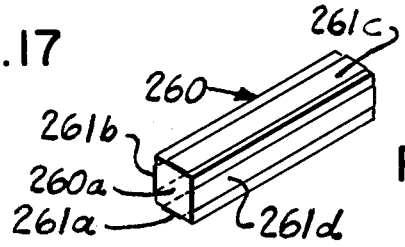
FIG. 17 is a perspective view of an individual fuse of the type used in the embodiment of FIGS. 15–16.

Referring to FIGS. 15–17, there is shown another fuse arrangement using the spacer 80 in which two pairs of special fuses 260 are used instead of the standard fuses 160. Each fuse 260 has a plastic, non-conductive, elongated fuse body 260*a* of square cross-section along the four sides of which are secured respective fuse element strips 261*a–d* made and secured as described for fuse elements 61*a–d* in FIG. 10. With this arrangement, seven spare sets of fuse elements are provided, three by elements 261*b–d* of the two active fuses 260, and the other four by the four elements of the spare fuses 260'.

Figure 18:
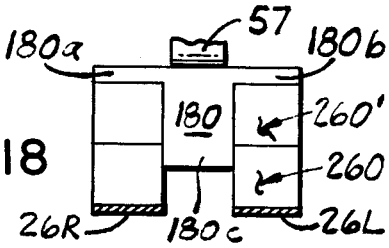
FIG. 18 is a view taken as in FIG. 15 and showing a modified spacer.

When fuses of the type 260, shown in FIG. 17, are used, the spacer 80 can be in the form 180 of a tee, as shown in FIG. 18, rather than a cross. Spacer 180 has its arms 180*a* pressing on the spare fuses 260', which in turn press down on the underlying active fuses 260. The leg 180*c* of the spacer 180 keeps the fuses at one side of the cavity 22 separated from the others.

It will be appreciated that more than one set of spares may be provided in the embodiments of FIGS. 15–16 and 18 by using smaller fuses. In such a case, the arms 80*a–*80*b* of the spacer 80 would be lowered accordingly. Although the slide door 23 is preferred, in the instance of the FIG. 18 embodiment, the spacer 180 could be held in place by other hold-down means, such as, for example, a screw passing downwardly through the leg 180*c* into the floor wall of the cavity 22 provided by the back body shell 21. In such an arrangement, the top of the spacer 180 would preferably be made flush with the front surface of the front body shell 20; i.e., the spacer would fill the opening 22'.

Referring to FIGS. 19–22, there is illustrated the use of still another fuse 360 for use in a plug body whose front and back shells 20'–21' are modified to the extent that the mouth of the cavity 22 is made square, numbered 122, and the floor thereof is provided with a pair of positioning lands 90 projecting upwardly along the longitudinal center line of the plug. These lands 90 are taller than the thickness of the wire contacts. Also, as shown in FIG. 22, the wire contacts 26L–26R have been modified (126L–126R) to each provide contact flanges 91L–91R opposite the contact arms 37L–37R. The fuses 360 have a square body 362 and two pairs of fuse elements 361*a–b* and 361*c–d* separated by positioning grooves 95–96 in the body 362. These fuse elements are made and secured in the same manner as fuse elements 61*a–d* but are differently positioned in that elements 361*c–d* extend at right angles relative to elements 361*a–b* rather than being parallel therewith. Also, the end portions 97 of the fuse elements 361*a–d* each extend partway over the respective narrow side face of the fuse body 362, as shown in FIG. 20. With this arrangement, the fuse elements not only engage the wire contacts 126L–126R and prong contacts 27L–27R, but also engage, by their end portions 97, the opposing contact flanges 91L–91R and contact arms 37L–37R. The fuses 360 can be stacked to provide several spares, as shown in FIG. 21. The positioning lands 90 and grooves 95–96 cooperate to indicate the proper manner in which to position a fuse in the cavity 122; and if a fuse is nevertheless installed incorrectly, the lands 90 prevent a short circuit from wire contact 126L to 126R by keeping the adjacent fuse element from being able to simultaneously engage both of these wire contacts because the lands 90 are taller than the thickness of the wire contacts.

It will be appreciated that the fuses 360 can also be made without the end portions 97 and that the wire contacts 26 can then be used rather than contacts 126L and 126R. In that instance, there will be bottom fuse contact only rather than both bottom and end fuse contact.

The described plug assembly is intended for use on an extension cord providing the leads 32L–32R. However, the various fuses and spare fuse arrangements described above are equally applicable for use on add-on plugs, such as commonly used on Christmas tree light sets, and on other fused units, such as fuse links used, for example, on Christmas tree light sets between the plug and the light sockets.

I claim:

1. A fused electrical unit comprising:

an electrically non-conductive body unit, first and second spaced sets of electrical contacts mounted in the body units, said first set comprising two electrical contacts separated by a first gap and said second set comprising two other electrical contacts separated by a second gap, respective electrical conductor means connected to said contacts within said body unit and extending out of the latter, said conductor means being in a circuit broken by said gaps, fuse means including first and second pairs of fuses in said body unit, each fuse having an elongated body, electrical contact portions at each end of said body, and a fuse element extending between said contact portions, said first pair of fuses being located in active position with their said contact portions engaging respective of said electrical contacts and their fuse elements separated and electrically bridging respective of said gaps, and said second pair of fuses being spares located in inactive position, and hold-down means operatively associated with said body unit and fuse means, said hold-down means retaining both pairs of fuses in the body unit and engaging said fuse means such as to keep the fuse elements of the first pair in active position.

2. A fused electrical unit according to claim 1 in which said hold-down means directly engages said first pair of fuses and separates said first and second pairs of fuses.

3. A fused electrical unit according to claim 1 in which said second pair of fuses engages the first pair of fuses, and said hold-down means engages said second pair and thereby holds down and retains both pairs.

4. A fused electrical conductor according to claim 1 in which said hold-down means extends as a spacer between the fuses of each said pair.

5. A fused electrical unit according to claim 1 in which said hold-down means separates the fuses of said first pair from one another.

6. A fused electrical unit according to claim 1 in which said hold-down means separates the fuses of said second pair from one another.

7. A fused electrical unit according to claim 1 in which said hold-down means separates the fuses of said first pair from one another and separates the fuses of the second pair from one another.

8. A fused electrical unit according to claim 1 in which said hold-down means separates each fuse from all of the other fuses.

9. A fused electrical unit according to claim 1 in which said hold-down means comprises a removable spacer unit engaging said fuse means and a removable keeper engaging said spacer unit and connected to said body unit to hold the spacer unit in operative position.

10. A fused electrical unit according to claim 9 in which said keeper is a slide door interfitting with said body unit.

11. A fused electrical unit according to claim 1 in which said body unit comprises two interfitting body shells, one of which provides an access opening for access to said fuses, and said hold-down means includes a closure for said access opening.

12. A fused electrical unit according to claim 1 in which a pair of parallel prong members project from said body unit and provide two of the electrical contacts in the body unit, one in each set, and in which an electric cord is connected to the other two electrical contacts.

13. A fused electrical unit according to claim 1 in which each of said fuses has multiple sets of contact portions and fuse elements arranged to be selectively placed in active position.

14. A fused electrical unit comprising:

an electrically non-conductive body unit, first and second spaced sets of electrical contacts mounted in the body units, said first set comprising two electrical contacts separated by a first gap and said second set comprising two other electrical contacts separated by a second gap, respective electrical conductor means connected to said contacts within said body unit and extending out of the latter, said conductor means being in a circuit broken by said gaps, fuse means including a pair of fuses in said body unit, each having an elongated, non-conductive body with a regular polygon-shaped, transverse cross-section defining an outer face for each side of the polygon, and each having a respective fuse element strip mounted on said faces, whereby each fuse has multiple spare fuse elements, said pair of fuses being positioned to locate a selected one of their fuse elements in active position electrically bridging respective of said gaps while the spare fuse elements are in inactive positions, and hold-down means operatively associated with said body unit and fuse means for retaining the fuse means and holding the selected fuse elements in active position.

15. A fused electrical unit according to claim 14 in which said hold-down means includes a spacer extending between said pair of fuses.

16. A fused electrical unit according to claim 14 in which said hold-down means includes a first member engaging said fuse means and a second member interfitting with said body unit and urging said first member against said fuse means.

17. A fused electrical unit according to claim 16 in which said second member is a slide door.

18. A fused electrical unit according to claim 14 in which said fuse means includes a second pair of said fuses for spares.

19. A fused electrical unit according to claim 14 in which said hold-down means engages said second pair of fuses which in turn engages the other pair of fuses to hold the selected elements of the latter in active position.

20. A fused electrical unit according to claim 14 in which said fuse means includes a second pair of said fuses, and said hold-down means has a spacer portion extending between said second pair of fuses and directly engaging the other pair of fuses to hold the selected elements of the latter in active position.

21. A fused electrical unit according to claim 20 in which said fuse means includes a movable door having open and closed positions which engages said spacer portion when the door is in closed position and gives access to the fuses when in its open position.

22. A fused electrical unit comprising:

an electrically non-conductive body unit, first and second spaced sets of electrical contacts mounted in the body unit, said first set comprising two electrical contacts separated by a first gap and said second set comprising two other electrical contacts separated by a second gap, respective electrical conductor means connected to said contacts within said body unit and extending out of the latter, said conductor means being in a circuit broken by said gaps, a first pair of fuses in said body having an active position in which the fuses bridge respective of said gaps to thereby make electrical connections between the contacts of the first set and between the contacts of the second set, and having an alternative inactive position in said body unit, a second pair of fuses in said body unit occupying said inactive position as a spare pair when said active pair is in said active position, and removable spacer means in said body unit electrically separating the fuses in the active position from one another and from the fuses in the inactive position.

23. A fused electrical unit according to claim 22 in which said spacer means is arranged to engage the pair of fuses in said active position to hold them in operative engagement with said contacts while keeping them spaced from the fuses occupying the inactive position.

24. A fused electrical unit according to claim 22 in which hold-down means is operatively associated with said body unit and said spacer means to keep the latter in engagement with said active fuses.

25. A fused electrical unit according to claim 22 in which said fuses are of the type having a center non-conducting tube, conductive caps on the ends of said tube, and a fuse element in said tube and having electrical contact with said end caps.

26. A fused electrical unit comprising:

an electrically non-conductive first body, first and second spaced sets of electrical contacts mounted in the first body, said first set comprising two electrical contacts separated by a first gap and said second set comprising two other electrical contacts separated by a second gap, respective electrical conductor means connected to contacts within said first body and extending out of said first body, an electrically non-conductive second body and third body removably associated with said first body and having alternative first and second locations in said first body, a first pair of spaced fuse elements mounted on said second body and arranged when said second body is in said first location and said third body is in said second location to bridge said gaps to thereby make electrical connections between the contacts of the first set and between the contacts of the second set, a second pair of spaced fuse elements mounted on said third body to serve as a spare for said first pair and arranged when said first body is in said second location and said third body is in said first location to bridge said gaps to thereby make said electrical connections.

27. A fused electrical unit according to claim 26 in which said second and third bodies each have a respective spare pair of fuse elements mounted thereon, said second and third bodies having alternative orientations while in said first location whereby their said spare pairs of fuse element can be positioned to bridge said gaps.

* * * * *